US005406977A

United States Patent [19]

Barbarin et al.

[11] Patent Number: 5,406,977

[45] Date of Patent: Apr. 18, 1995

[54] AUTOMATIC FLOWRATE REGULATOR FOR VENTILATION AND AIR-CONDITIONING INSTALLATIONS

[76] Inventors: Christian Barbarin, Torcieu, France, FR-01230; Laurent Barbarin, 35 Rue des Artènes, Amberieu, both of France, FR-01500

[21] Appl. No.: 268,105

[22] Filed: Jul. 6, 1994

[30] Foreign Application Priority Data

Jul. 15, 1993 [FR] France ..... 93 08921

[51] Int. Cl.[6] ..... G05D 7/01

[52] U.S. Cl. ..... 137/514; 137/499; 137/521

[58] Field of Search ..... 137/514, 521, 499

[56] References Cited

U.S. PATENT DOCUMENTS 3,191,615 6/1965 Edwards ..... 137/499

4,117,860 10/1978 Carlin ..... 137/521 X

*Primary Examiner*—Robert G. Nilson

*Attorney, Agent, or Firm*—Dowell & Dowell

[57] ABSTRACT

This invention relates to an automatic flowrate regulator for ventilation and air-conditioning installations, wherein it comprises a rigid flap articulated in the body and which is subjected, on the one hand, to elastic means, on the other hand, to the pressure of the air stream, this antagonistic action ensuring control of said flap which at any moment leaves free a section adapted to ensure balancing of the installation.

5 Claims, 2 Drawing Sheets

AUTOMATIC FLOWRATE REGULATOR FOR VENTILATION AND AIR-CONDITIONING INSTALLATIONS

FIELD OF THE INVENTION

The present invention relates to an automatic flowrate regulator intended for equipping the terminal conduits of ventilation, air-conditioning or like installations, with a view to maintaining a determined flowrate independently of the pressure variations.

BACKGROUND OF THE INVENTION

Up to recent times, this result was obtained with the aid of manually manoeuvred adjusting flap valves, constituted in fact by apparatus similar to slide valves. As initial adjustment of the flap valves proved to be delicate and the characteristics of the installation varied in time, automatically operating regulators have been proposed, making it possible, by modifying the section of air passage, to obtain a constant flowrate whatever the variations in the pressure inside the conduits.

In known regulators, the section of passage is modified with the aid of a mobile member on which the pressure of the air conveyed and suitably arranged elastic means act in antagonism. However, experience has shown that the constructions proposed are complex and expensive, frequently prove to function noisily and present a range of regulation of low amplitude, unstable in time.

It is an object of the present invention to overcome these drawbacks.

SUMMARY OF THE INVENTION

To that end, the automatic flowrate regulator of the type described above comprises, in combination:

- a tubular body adapted to define a conduit presenting two parallel plane walls joined by a plane wall and by an arcuate wall, said body being arranged to be connected to a pipe;
- a rigid flap which, presenting a profile similar to that of the section of the conduit mentioned above, is articulated on the body transversely with respect to the axis of the conduit thereof and which is associated with two stops which define a position of maximum closure and a position of maximum opening, this latter forming a pressure chamber which is closed at the level of the articulation of the flap and which opens upstream in the sense of circulation of the air;
- elastic means associated with the flap with a view to returning the latter to the position of maximum opening;
- and a damper of which the mobile member is coupled to the flap with a view to eliminating the pumping effects.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
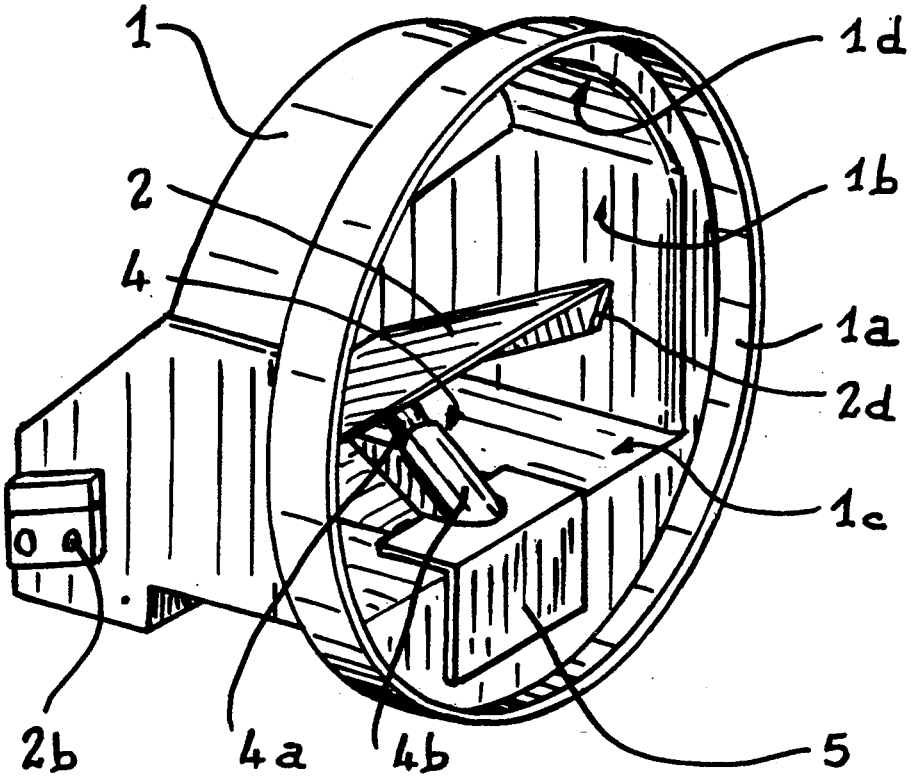
FIG. 1 is a view in perspective illustrating the general arrangement of an automatic regulator according to the invention.

Referring now to the drawings, the regulator in question comprises a tubular body 1 which will be assumed to be made of moulded plastics material, which body comprises at least one end collar l*a* adapted to fit on a pipe C. The axial opening of the body 1 defines an air passage conduit which presents two opposite plane walls 1*b* oriented parallel to each other, a plane wall 1*c* oriented perpendicularly to said walls 1*b*, and a wall 1*d* of arcuate or vaulted profile facing said wall 1*c*.

Body 1 contains a rigid flap 2 which is dimensioned in width so as to fit with reduced clearance between the parallel walls 1*b* of the conduit. The lower face of this flap 2 comprises a tab 2*a* turned obliquely downwards, of which the free end is fast with two catches 2*b* which project outwardly in order to engage in corresponding depressions in the body 1 and thus to form a pivot axis for said flap.

It will be observed that the transverse edge of this flap 2 which is opposite the collar 1*a*, beyond axis 2*b*, is curved in the direction of the corresponding part of the body 1 in order to define a sort of beak 2*c* adapted to abut against the body 1 with a view to constituting a stop limiting tipping of the flap 2 into closure position. To this maximum stop 2*c* there corresponds a minimum stop constituted by two lateral flanges 2*d* fast with the lower face of the flap 2 to abut against the wall 1*c* of the conduit.

With flap 2 are associated elastic means for return into open position, which are constituted by one or more blades 3 inserted in a slot provided to the rear of the tab 2*a* in order to be applied against the body 1, below beak 2*c*. Opposite these elastic means 3 there is provided a damper 4 which comprises a piston 4*a* connected to the lower wall of the flap 2, which piston is engaged to slide in virtually tight manner in a cylinder 4*b* which is itself connected to a small bracket 5 clipped in an opening of the wall 1*c*.

Operation of the regulator according to the invention follows from the foregoing explanations and will be readily understood.

Figure 2:
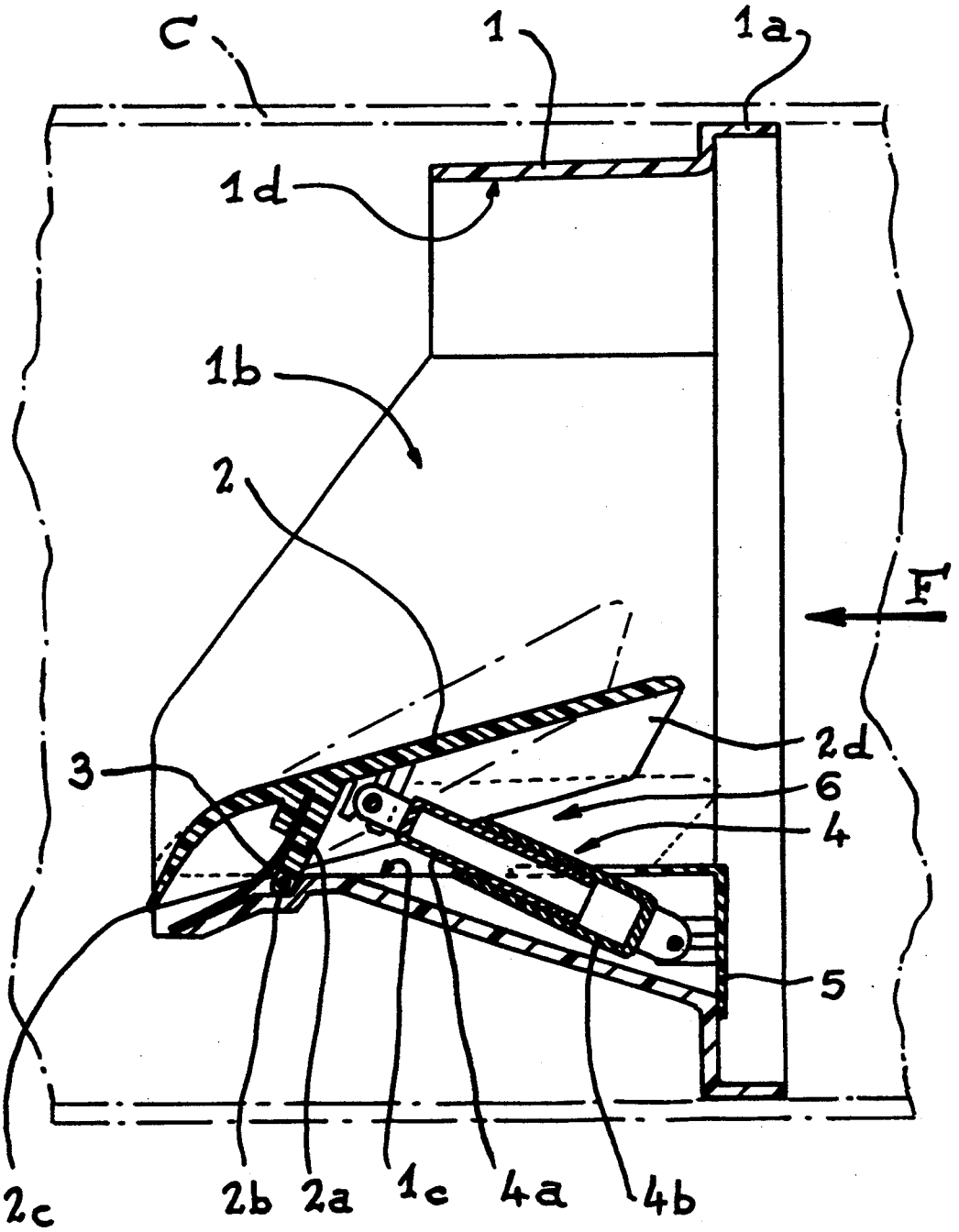
FIG. 2 is a schematic axial section of the regulator according to FIG. 1.

When the air contained in pipe C is not under pressure or at least the air stream which traverses said pipe and the conduit of the regulator presents only a low differential pressure, the action of the elastic means on the flap 2 is preponderant, so that said flap is maintained in the fully open position for which the flanges abut against the wall 1*c*. However, it should be observed that, in this position, the presence of said flanges 2*d* makes a free space between the lower face of the flap and the wall 1*c* of the conduit, which free space, open in the direction of pipe C, i.e. towards upstream in the direction of circulation of the air (arrow F), acts as pressure chamber, referenced 6 in FIG. 2.

Under these conditions, when the pressure in this chamber 6 increases, the flap 2 rises against the elastic means 3, thus reducing the surface of the section left free in the conduit by said flap. The flowrate of air is thus automatically reduced, until a position of equilibrium between the differential pressure prevailing on either side of the regulator and the elastic return means, is attained. This position of equilibrium determines a free section of air passage corresponding to a flowrate as a function of the said differential pressure, it being noted that the bearing surface of the beak 2*c* against the body 1 in any case limits the angular displacement of the flap and avoids too great an obturation.

A regulation of the flowrates in such or such branch of a network as a function of needs is therefore obtained, independently of the different pressures prevailing in the network in question of the ventilation installation with which the regulator is associated. Due to this arangement, the damper 4 associated with the flap 2 in no way hinders the slow angular displacement of said flap; it intervenes only to oppose the phenomena of "beat" or of "pumping" of which the flap valves of ventilation installations are frequently the seat.

It goes without saying that, for the precise adaptation of the regulator according to the invention to the flow characteristics of the installation for which it is intended, section reducers may be provided, fixed removably, for example by simple elastic clipping, in that part of the conduit which is not occupied by the flap 2, i.e. at the level of the arcuate wall 1*d*.

It must, moreover, be understood that the foregoing description has been given only by way of example and that it in no way limits the domain of the invention which would not be exceeded by replacing the details of execution described by any other equivalents.

What is claimed is:

1. An automatic flowrate regulator for ventilation, air-conditioning or like installations, of the type equipped with a mobile member on which the differential pressure of the air prevailing on either side of said mobile member and elastic means act in antagonism, with a view to modifying the section of air passage, wherein it comprises, in combination:

a tubular body adapted to define a conduit presenting two parallel plane walls joined by a plane wall and an arcuate wall, said body being arranged to be connected to a pipe;

a rigid flap which, presenting a profile similar to that of the section of the conduit mentioned above, is articulated on the body transversely with respect to the axis of the conduit thereof, which flap is associated with two stops which define a position of maximum closure and a position of maximum opening, this latter forming a pressure chamber which is closed substantially at the level of the articulation of the flap and which opens upstream in the sense of circulation of the air;

elastic means associated with the flap with a view to returning the latter to the position of maximum opening;

and a damper of which the mobile member is coupled to the flap with a view to eliminating the pumping effects.

2. The regulator of claim 1, wherein the elastic means associated with the flap are constituted by at least one blade of which one end abuts against the body whilst the opposite end is rendered fast with said flap.

3. The regulator of claim 1, wherein the stop defining the position of maximum closure is constituted by the transverse edge, curved in the form of a beak, of the flap which is disposed to the rear of the pivot axis.

4. The regulator of claim 1, wherein the stop defining the position of maximum opening is constituted by two lateral flanges provided on that face of the flap which faces the direction of the plane wall of the conduit.

5. The regulator of claim 1, wherein the damper comprises a mobile member in the form of a piston introduced with virtually tight slide in a cylinder, the elements of this damper being connected to the flap and to the body.

* * * * *